US009707439B2

(12) United States Patent
Lee et al.

(10) Patent No.: US 9,707,439 B2
(45) Date of Patent: Jul. 18, 2017

(54) ELLIPTICAL MACHINE

(71) Applicant: Superweigh Enterprise Co., Ltd., Nan-Tou Hsien (TW)

(72) Inventors: Sunny Lee, Nan-Tou Hsien (TW); Simon Chao, Nan-Tou Hsien (TW)

(73) Assignee: Superweigh Enterprise Co., Ltd., Nan-Tou Hsien (TW)

( * ) Notice: Subject to any disclaimer, the term of this patent is extended or adjusted under 35 U.S.C. 154(b) by 37 days.

(21) Appl. No.: 14/937,293

(22) Filed: Nov. 10, 2015

(65) Prior Publication Data

US 2017/0128768 A1 May 11, 2017

(51) Int. Cl.
*A63B 22/06* (2006.01)
*A63B 22/04* (2006.01)
*A63B 22/00* (2006.01)

(52) U.S. Cl.
CPC ..... *A63B 22/001* (2013.01); *A63B 22/0664* (2013.01)

(58) Field of Classification Search
CPC ... A63B 22/001; A63B 22/0664; A63B 22/00; A63B 22/04; A63B 22/06
USPC ..... 482/52
See application file for complete search history.

(56) References Cited

U.S. PATENT DOCUMENTS 6,004,244 A * 12/1999 Simonson ..... A63B 21/153 482/51
9,295,874 B1 * 3/2016 Chen ..... A63B 22/0023
2008/0261780 A1 * 10/2008 Giannelli ..... A63B 22/001 482/52
2008/0287265 A1 * 11/2008 Giannelli ..... A63B 22/001 482/52
2009/0005222 A1 * 1/2009 Liao ..... A63B 22/001 482/52
2012/0077645 A1 * 3/2012 Lee ..... A63B 22/001 482/52
2013/0085042 A1 * 4/2013 Huang ..... A63B 22/04 482/52
2014/0051552 A1 * 2/2014 Habing ..... A63B 21/154 482/52
2014/0371032 A1 * 12/2014 Peng ..... A63B 22/001 482/52
2015/0182787 A1 * 7/2015 Liu ..... A63B 22/001 482/52
2015/0182788 A1 * 7/2015 Dalebout ..... A63B 22/0664 482/52
2016/0158595 A1 * 6/2016 Dalebout ..... A63B 22/001 482/52

* cited by examiner

*Primary Examiner* — Andrew S Lo
(74) *Attorney, Agent, or Firm* — The Webb Law Firm

(57) ABSTRACT

An elliptical machine includes a transmission unit and two exercise units. The transmission unit includes two transmission rods connected pivotally to a fly wheel unit, and two swing rods each being connected pivotally to a respective transmission rod. Each exercise unit includes a connecting rod connected pivotally to a pedal rod and a respective swing rod. A distance from an intersection of the connecting rod and the respective swing rod to a top end of the respective swing rod is larger than that from an intersection of the respective swing rod and the respective transmission rod to the top end of the respective swing rod.

8 Claims, 12 Drawing Sheets

ELLIPTICAL MACHINE

FIELD

The disclosure relates to an elliptical machine, more particularly to a front-mounted suspension type elliptical machine with a large span that users can exercise on.

BACKGROUND

An elliptical machine is a fitness equipment for training a user's leg muscles with continuous stepping action. The training theory is to drive rotation of a fly wheel unit by stepping on a pair of foot pedals, so that each foot pedal moves along an elliptical path. In addition, the training difficulty is adjustable during the training process by adjusting the resistance of the fly wheel unit.

Referring to FIG. 1, a conventional rear-mounted suspension type elliptical machine 1 mainly includes a base seat 11, a control panel 12 mounted to a front end of the base seat 11, a fly wheel unit 13 mounted at a rear end of the base seat 11, two transmission rods 14 connected pivotally to the fly wheel unit 13, and two foot pedals 15 respectively mounted on the transmission rods 14.

Due to the location of the fly wheel unit 13, the length of the conventional rear-mounted suspension type elliptical machine 1 is relatively large. Moreover, a user is restricted to stepping onto the foot pedals 15 from two lateral sides of the seat 11, which results in inconvenient usage.

Referring to FIG. 2, a conventional front-mounted roller type elliptical machine 2 mainly includes a base seat 21, a fly wheel unit 22 mounted to a front end of the base seat 21, a control panel 23 mounted above the fly wheel unit 22, a track seat 24 mounted at a rear side of the base seat 21, and two transmission rods 25. Each of the transmission rods 25 has one end connected pivotally to the fly wheel unit 22, and an opposite end mounted slidably on the track seat 24. The conventional front-mounted roller type elliptical machine 2 further includes two pedal rods 26 connected pivotally and respectively to the transmission rods 25, and two foot pedals 27 mounted respectively on the pedal rods 26.

However, since the transmission rods 25 are slidable along the track seat 24 through rollers 28, the rollers 28 may produce noise due to friction between the rollers 28 and the track seat 24, so that the track seat 24 needs to be periodically maintained with lubricant. Furthermore, after long-term use of the conventional front-mounted roller type elliptical machine 2, dirt or grime may accumulate in the track seat 24.

SUMMARY

Therefore, the object of the disclosure is to provide an elliptical machine that produces less noise, that can be conveniently operated, that is durable, and that increases exercise efficiency.

Accordingly, an elliptical machine of the present disclosure includes a frame unit, a transmission unit and two exercise units. The frame unit includes a main frame, and a side frame extending rearwardly from the main frame. The transmission unit includes a fly wheel unit mounted to the main frame, two transmission rods connected pivotally and respectively to opposite sides of the fly wheel unit, and two swing rods. Each of the swing rods is connected pivotally to a distal end of a respective one of the transmission rods that is distal from the fly wheel unit, and is swingably suspended from the side frame. Each of the two exercise units includes a pedal rod adjacent to and at a lateral outer side of a respective one of the transmission rods, a foot pedal mounted on the pedal rod, and a connecting rod having opposite ends that are connected pivotally and respectively to the pedal rod and a respective one of the swing rods. A distance from an intersection of said connecting rod and the respective one of the swing rods to a top end of the respective one of the swing rods is larger than that from an intersection of the respective one of the swing rods and the respective one of the transmission rods to the top end of the respective one of the swing rods.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 3:
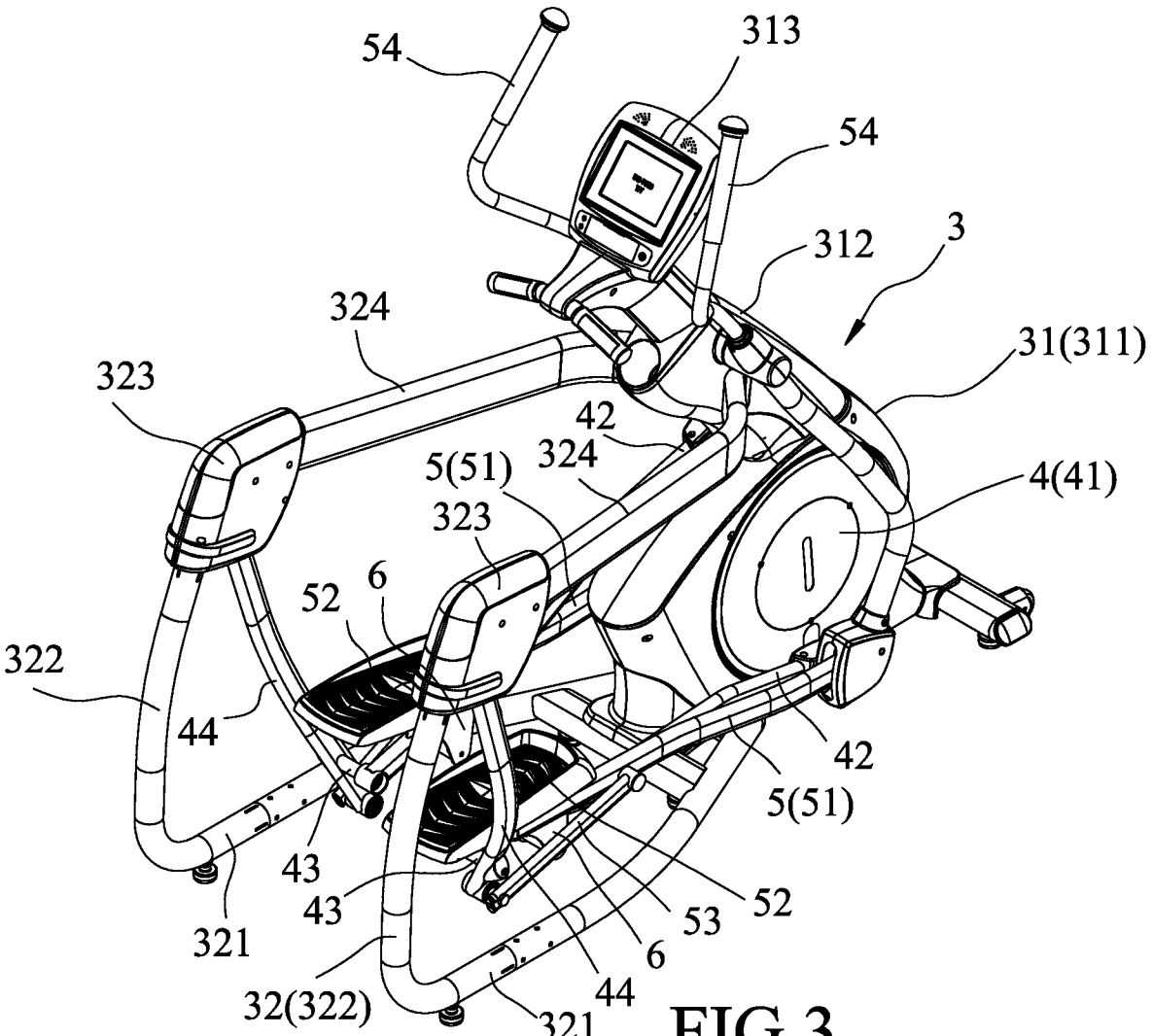
FIG. 3 is a perspective view of an embodiment of an elliptical machine according to the disclosure.
Figure 4:
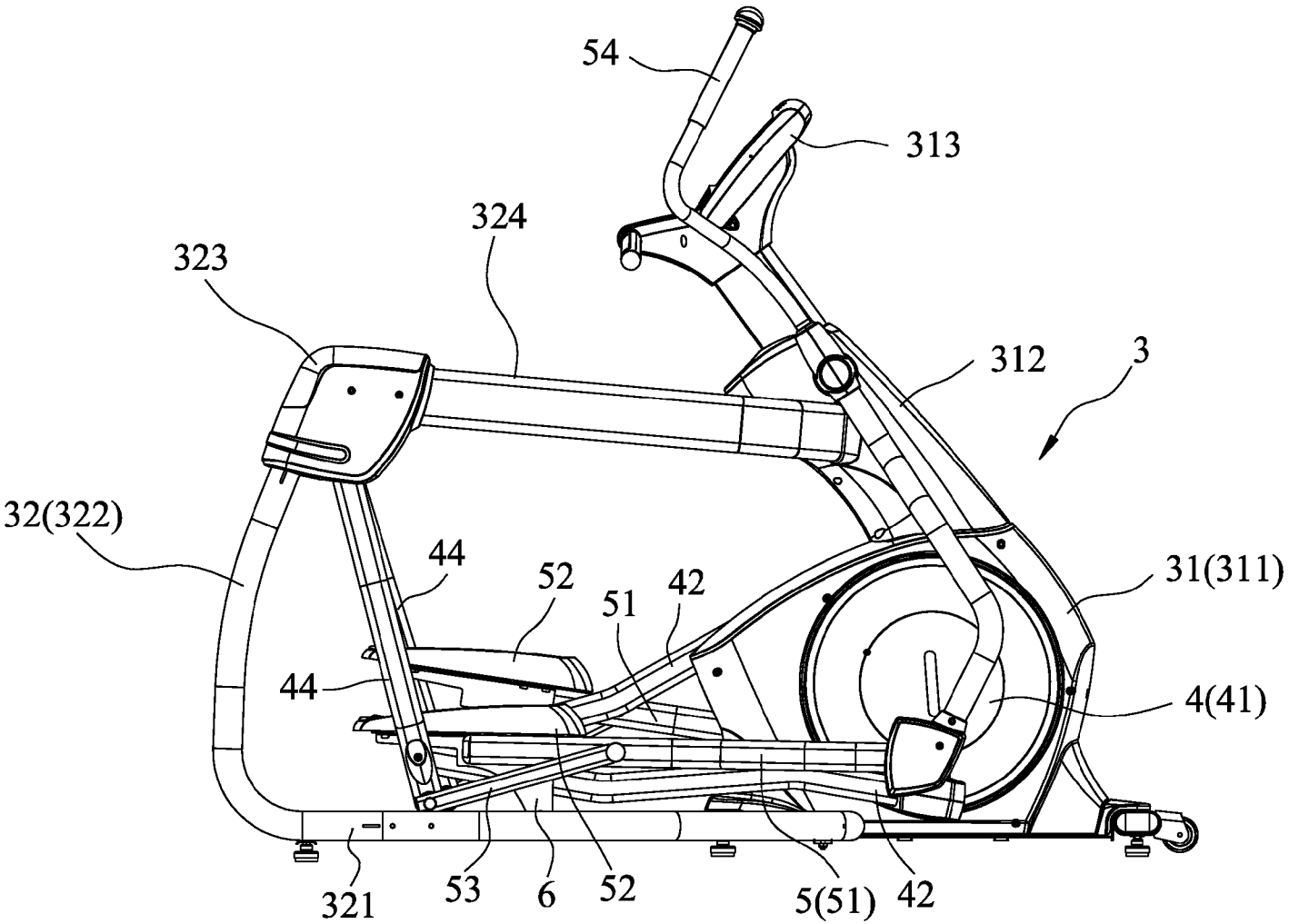
FIG. 4 is a side view of the embodiment.

Referring to FIGS. 3 and 4, the embodiment of an elliptical machine according to the present disclosure includes a frame unit 3, a transmission unit 4, two exercise units 5 and two linking units 6.

The frame unit 3 includes a main frame 31, and a side frame 32 extending rearwardly from the main frame 31.

The main frame 31 has a wheel seat part 311, an extension part 312 extending upwardly from the wheel seat part 311, and a control panel part 313 mounted on the extension part 312.

The side frame 32 has two foot frames portions 321 extending respectively and rearwardly from opposite sides of the wheel seat part 311 of the main frame 31, two first support rod portions 322 extending respectively and upwardly from the foot frame portions 321, two joint portions 323 mounted respectively to top ends of the first support rod portions 322, and two second support rod portions 324 extending respectively and forwardly from the joint portions 323 to the extension part 312 of the main frame 31.

The foot frame portions 321, the first support rod portions 322, the joint portions 323 and the second support rod portions 324 form a stable supporting structure, and the second support rod portions 324 are designed to be held by a user when stepping on the elliptical machine.

Figure 5:
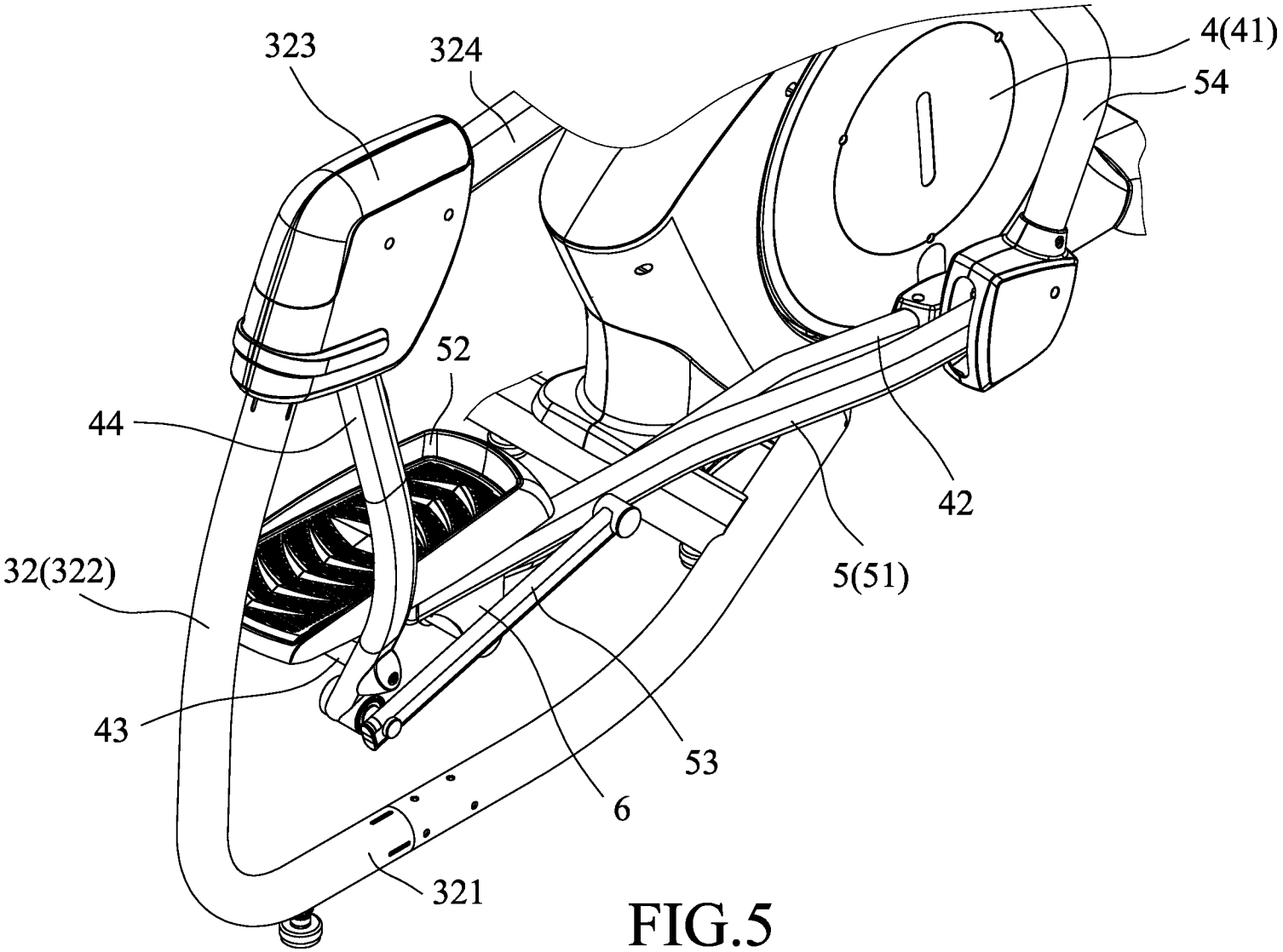
FIG. 5 is a fragmentary perspective view illustrating the connection between a transmission unit and an exercise unit.
Figure 6:
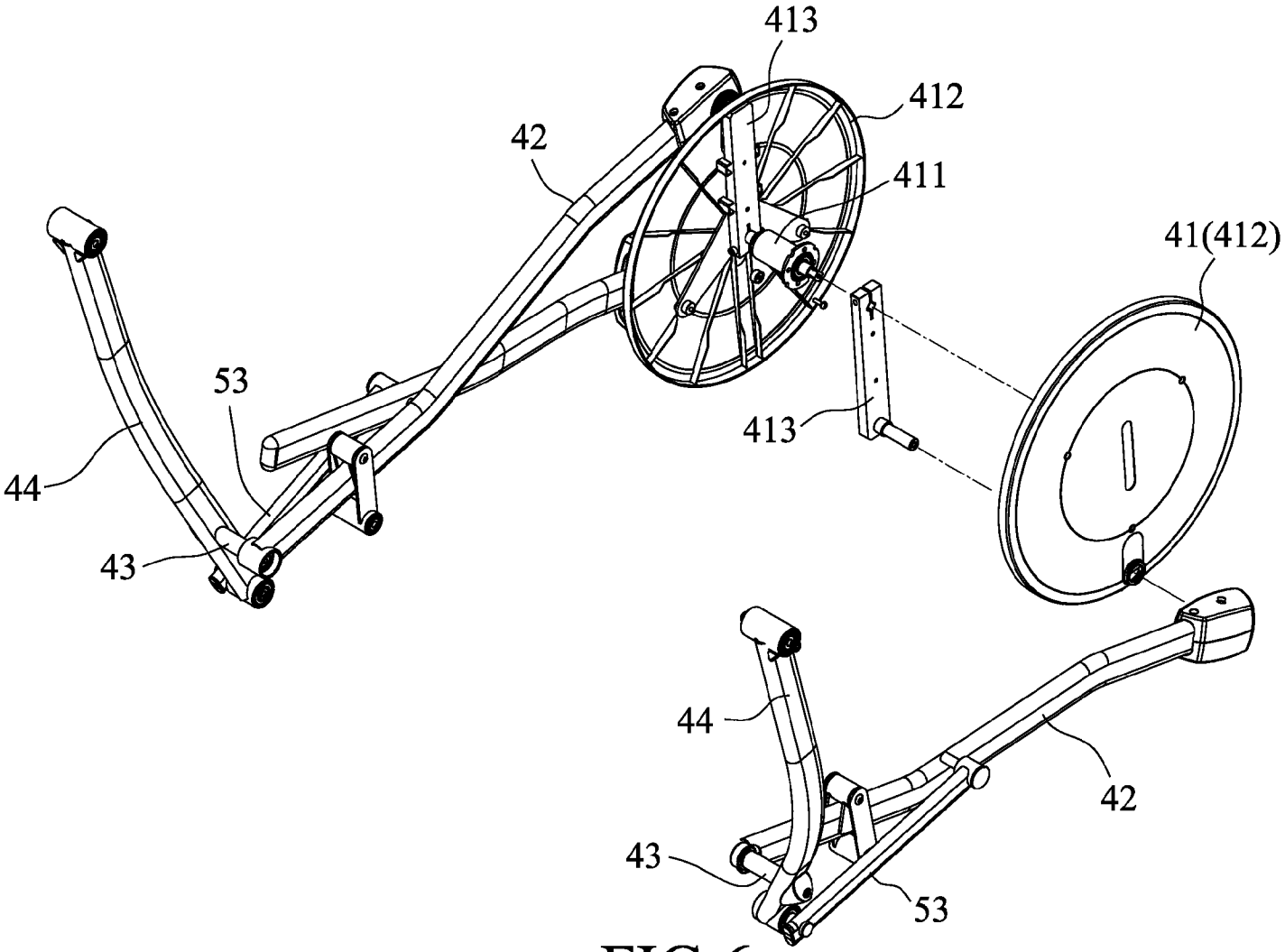
FIG. 6 is a partly exploded perspective view of a transmission unit of the embodiment.

As shown in FIGS. 3, 5 and 6, the transmission unit 4 includes a fly wheel unit 41 mounted to the wheel seat part 311 of the main frame 31, two transmission rods 42 connected pivotally and respectively to opposite sides of the fly wheel unit 41, and two swing rods 44. Each of the swing rods 44 is connected pivotally to a distal end of a respective one of the transmission rods 42 that is distal from the fly wheel unit 41, and is swingably suspended from a respective one of the joint portions 323 of the side frame 31. The transmission unit 4 further includes two interconnecting rods 43, each of which is connected transversely and pivotally to a respective one of the swing rods 44, and connected transversely and pivotally to the distal end of the respective one of the transmission rods 42.

The fly wheel unit 41 has a rotary shaft 411, two cranks 413, and two rotary wheels 412. The cranks 413 are connected respectively from opposite lateral ends of the rotary shaft 411, extend respectively in opposite directions, and are connected respectively and pivotally to the transmission rods 42. The rotary wheels 412 are mounted respectively to the cranks 413. The transmission mechanism of the fly wheel unit 41 is well known in the art, and is therefore not further described herein.

Each of the exercise units 5 includes a pedal rod 51 adjacent to and at a lateral outer side of the respective one of the transmission rods 42, a foot pedal 52 mounted to the distal end of the pedal rod 51, a connecting rod 53 having opposite ends that are connected pivotally and respectively to the pedal rod 51 and the respective one of the swing rods 44, and a handle 54 extending pivotally from a front end of a respective one of the pedal rods 51 and having a middle portion that is connected pivotally to the extension part 312 of the main frame 31. The top portions of the two handles 54 are respectively located at opposite lateral sides of the control panel part 313 of the main frame 31.

Figure 7:
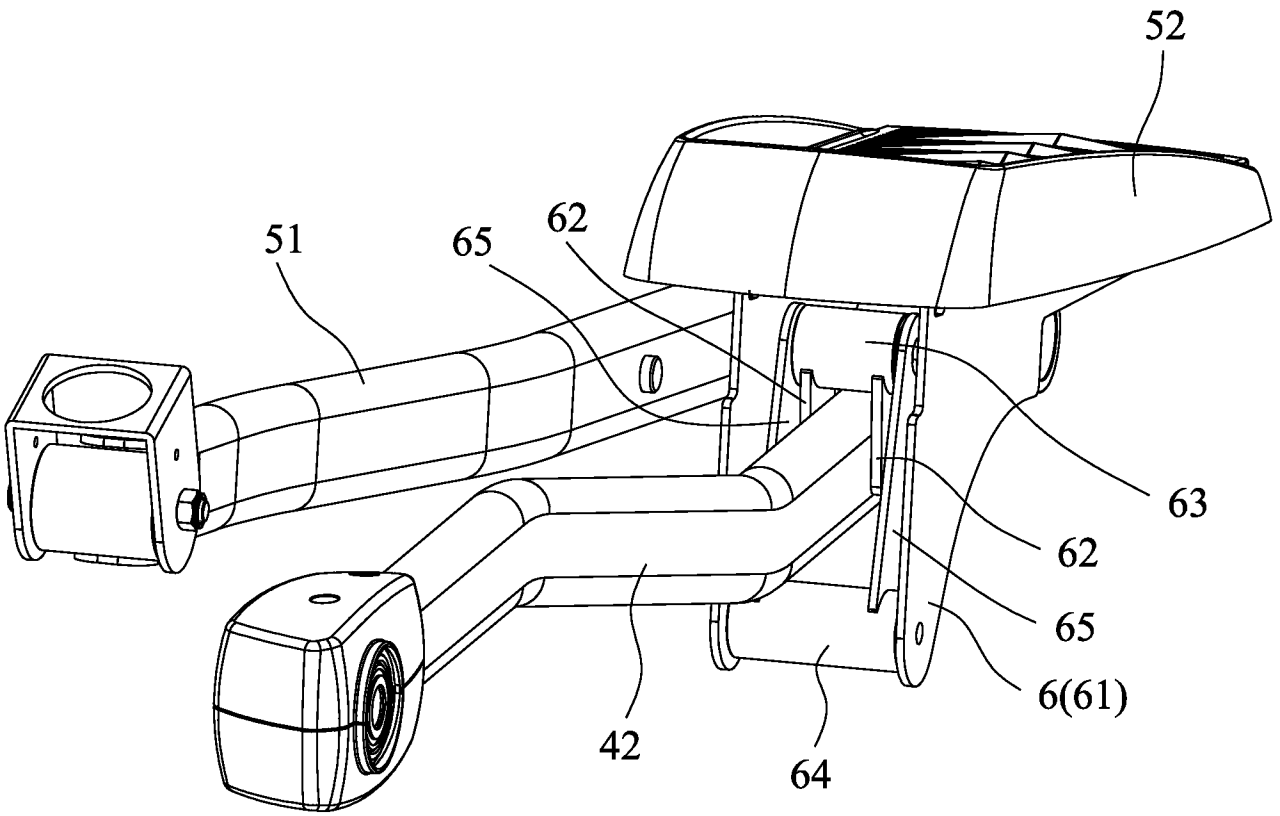
FIG. 7 is an assembled perspective view of a linking unit, the exercise unit and the transmission unit of the embodiment.
Figure 8:
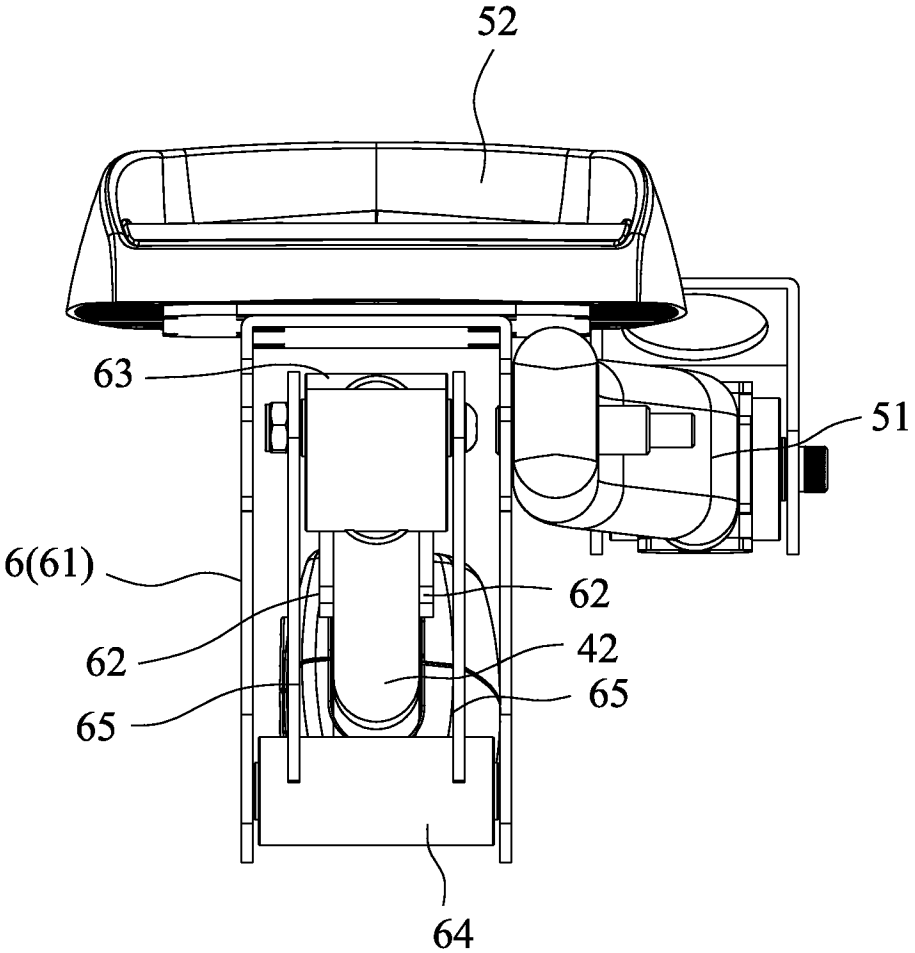
FIG. 8 is a rear view of the linking unit.
Figure 9:
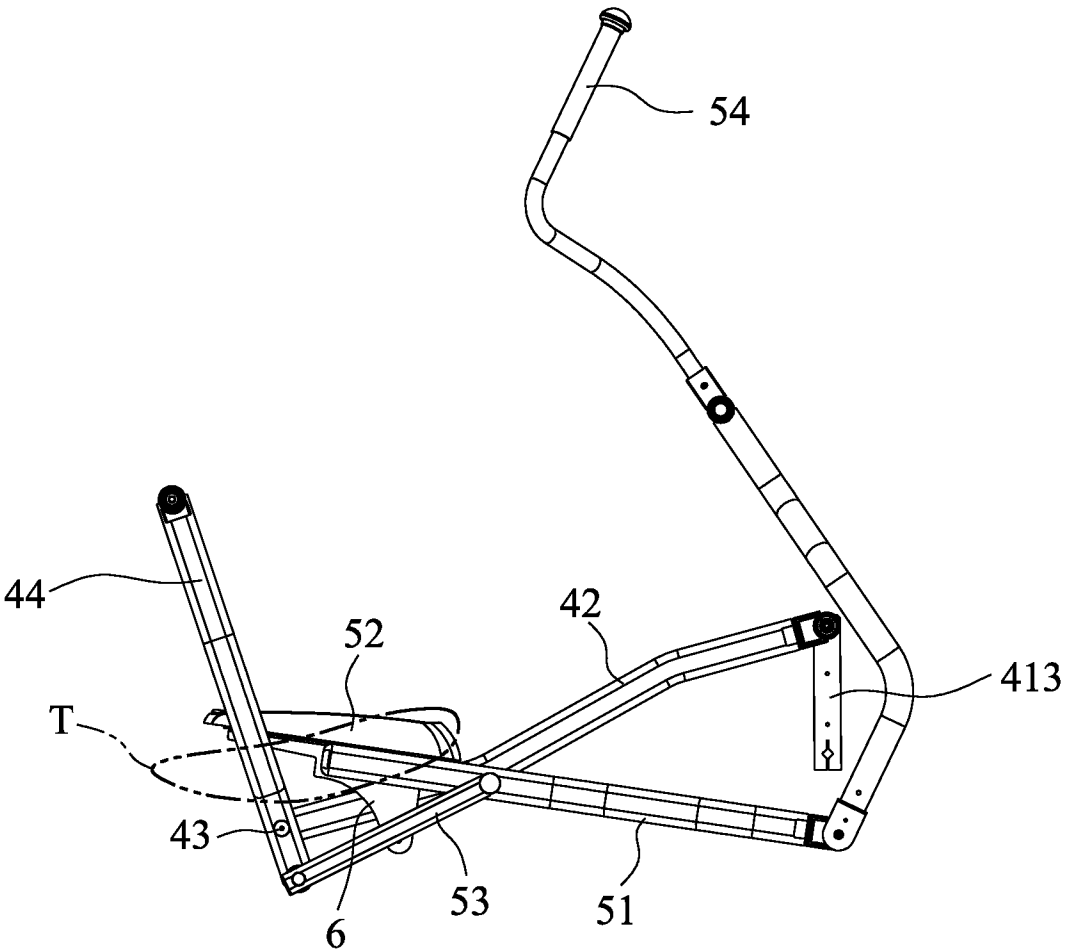
FIG. 9 is a schematic view illustrating a transmission rod of the transmission unit when being swung to a highest position.

As shown in FIGS. 7 and 8, each of the linking units 6 includes a linking seat 61, two fixing plates 62, a first shaft 63, a second shaft 64, and two linking plates 65. The linking seat 61 is mounted to a bottom end of the foot pedal 52 of a respective one of the exercise units 5, and cooperates with the foot pedal 52 of the respective one of the exercise units 5 to surround a respective one of the transmission rods 42. The fixing plates 62 are disposed respectively at opposite lateral sides of the linking seat 61. The first shaft 63 is connected transversely to the fixing plates 62, and is disposed over the respective one of the transmission rods 42. The second shaft 64 is connected transversely to a bottom portion of the linking seat 61, and is disposed under the respective one of the transmission rods 42. The linking plates 65 are respectively and pivotally connected to opposite lateral ends of the first shaft 63, and extend downwardly to the second shaft 64. The fixing plates 62 and the linking plates 65 extend in an extending direction perpendicular to the first and second shafts 63, 64. As such, when one of the foot pedals 52 and a corresponding one of the pedal rods 51 swing, the linking seat 61, the second shaft 64 and the linking plates 65 of a corresponding one of the linking units 6 swing relative to the first shaft 63, the fixing plates 62 of the corresponding one of the linking units 6 and a corresponding one of the transmission rods 42. In order to avoid interference, for each of the linking units 6, a longitudinal length of the second shaft 64 is larger than that of the first shaft 63, and a length of each of the linking plates 65 in the extending direction is larger than that of the fixing plates 62.

As shown in FIG. 3 and FIGS. 9 to 12, in operation, the user holds the second support rod portions 324 and steps down on the foot pedals 52 from a rear side of the side frame 32, then holds the handles 54 and drives pivot movements of the pedal rods 51 relative to the handles 54 with continuous steps. The connecting rods 53 are driven by the pedal rods 51 to rotate, enabling the swing rods 44 to swing back and forth, thereby driving rotation of the rotary wheel 412 through the interconnecting rods 43 and the transmission rods 42. The fly wheel unit 41 provides a constant rotary speed and moves each of the foot pedals 52 to repeatedly move along a substantially elliptical track (T) as shown by the phantom line in FIG. 9, and also provides an adjustable rotational resistance, thereby effectively training the user's leg muscles. At the same time, the user's arm muscle can be trained by swinging the handles 54 back and forth during the abovementioned operation.

Figure 10:
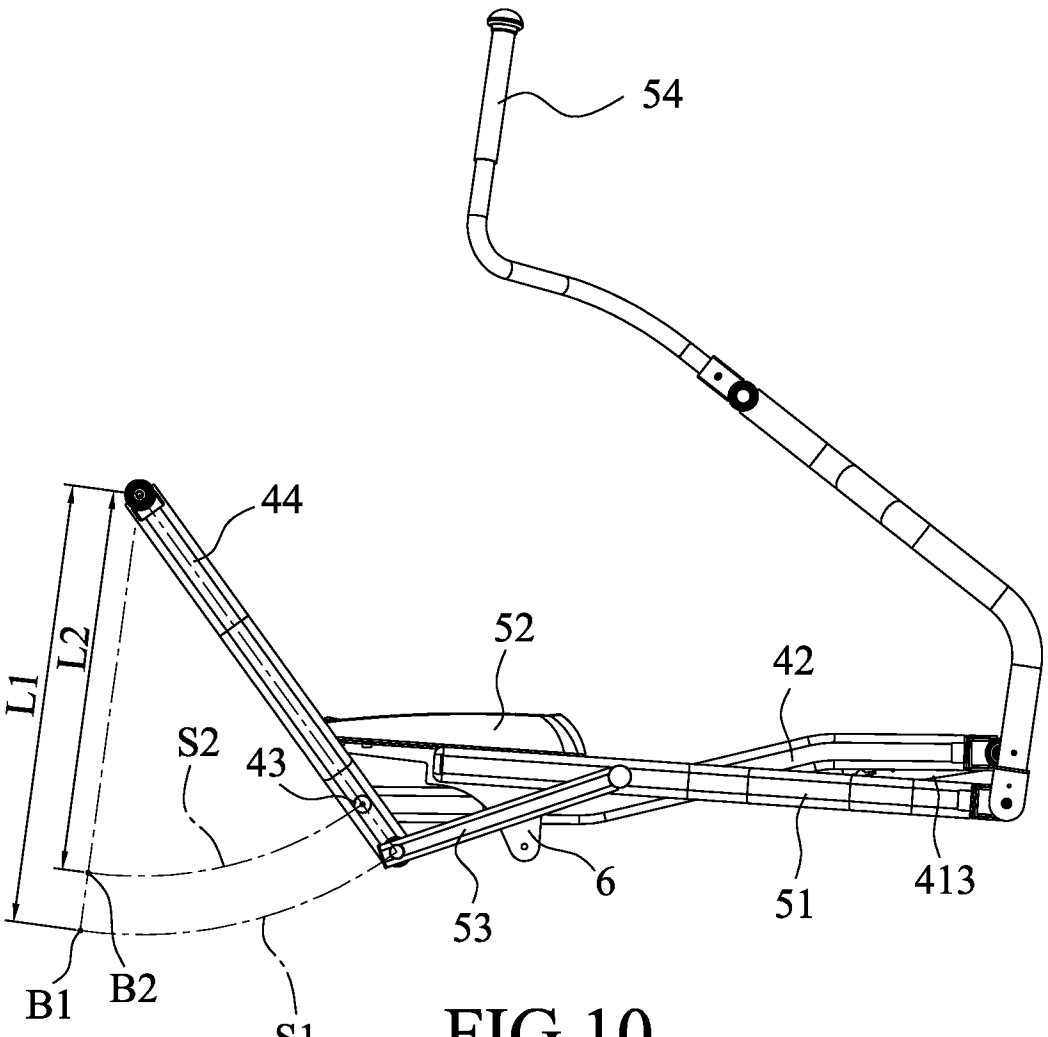
FIG. 10 is a schematic view illustrating the transmission rod when being swung to a frontmost position.
Figure 11:
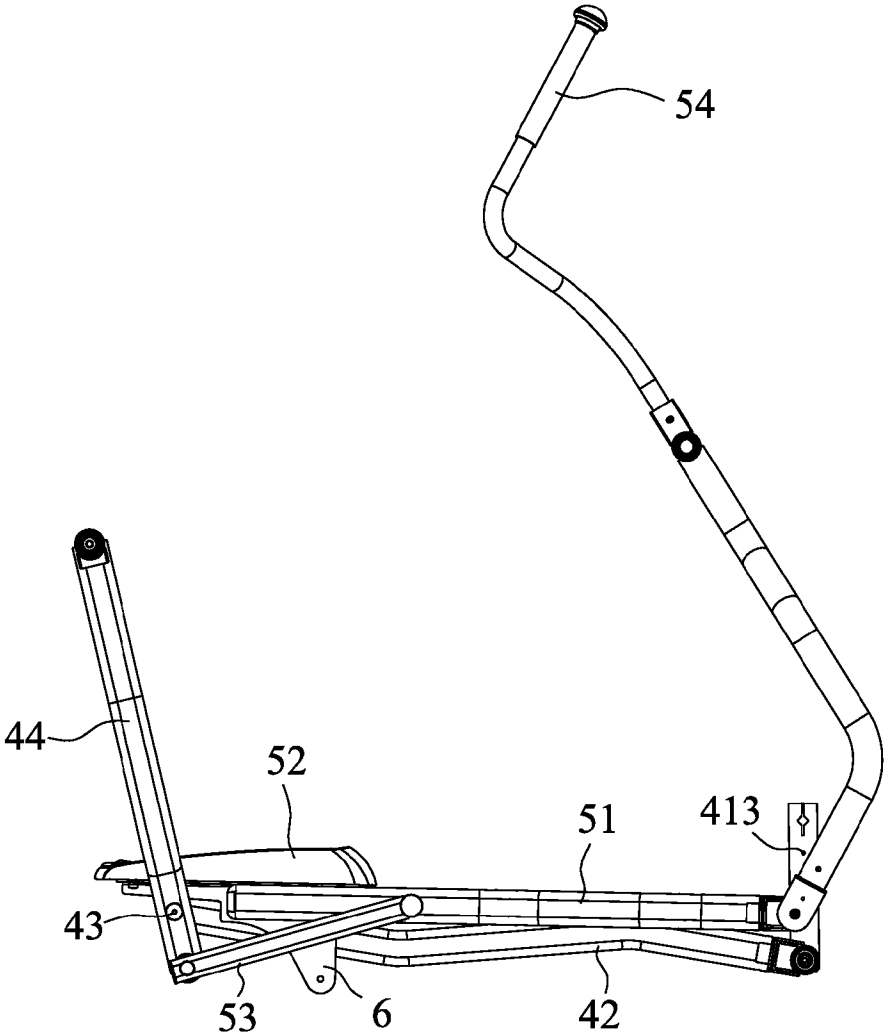
FIG. 11 is a schematic view illustrating the transmission rod when being swung to a lowest position.
Figure 12:
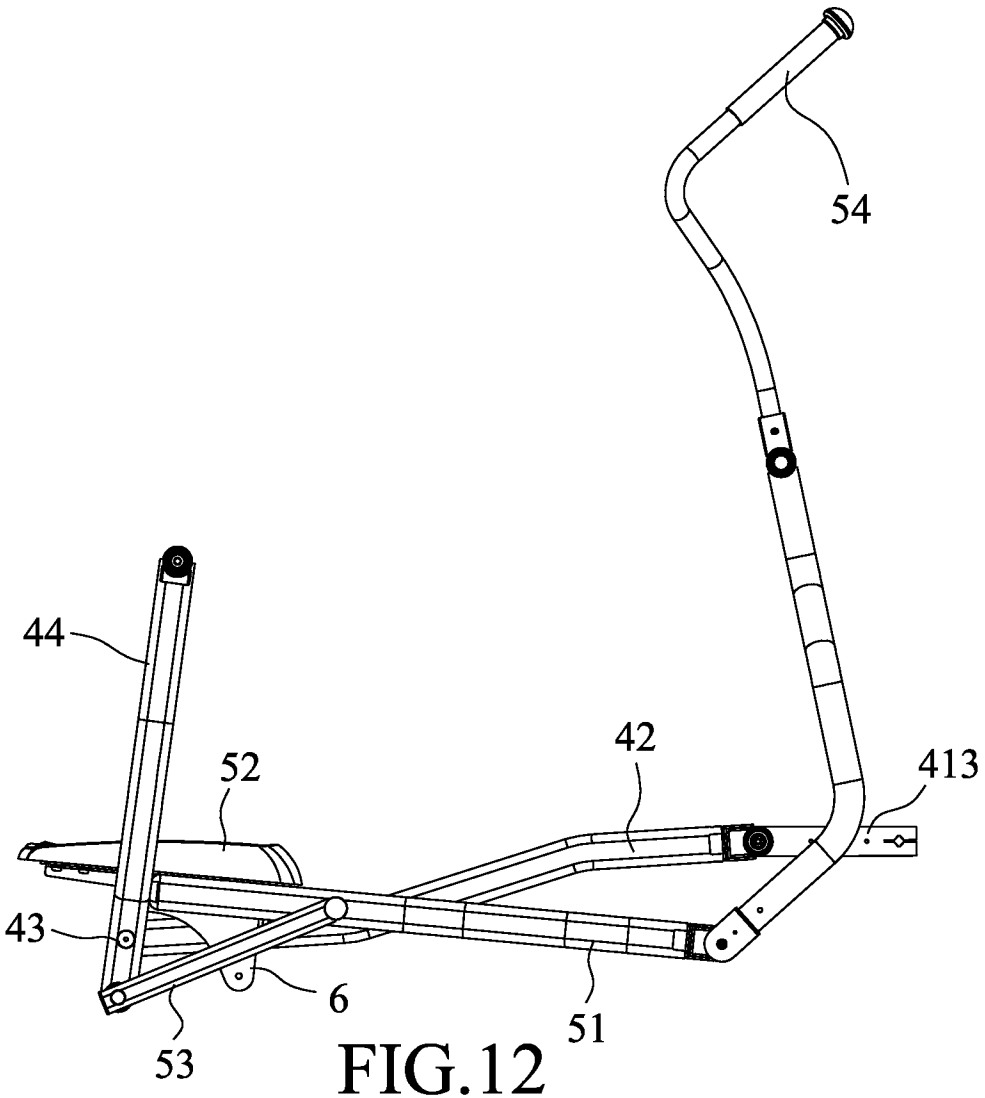
FIG. 12 is a schematic view illustrating the transmission rod when being swung to a rearmost position.

In addition, as shown in FIG. 10, for each of the exercise units 5, a distance (L1) from an intersection (B1) of the connecting rod 53 and the respective one of the swing rods 44 to a top end of the swing rod 44 is larger than a distance (L2) from an intersection (B2) of the respective one of the swing rods 44 and the respective one of the transmission rods 42 to the top end of the swing rod 44 (i.e., (L1)>(L2)). Therefore, according to a mathematical formula for calculating an arc length of a circular sector, during the swing action of the respective one of the swing rods 44, the length of a first path (S1) along which the intersection (B1) moves is larger than the length of a second path (S2) along which the intersection (B2) moves, and a condition of S1:S2=L1:L2 is satisfied.

It should be noted that, the length of the second path (S2) represents the length of a major axis of an elliptical track along which an existent elliptical machine's foot pedal moves. For the existent elliptical machine, such length of the major axis of the elliptical track represents the span distance of each step of the user, and is decided by the length of a crank under the ratio that such length of the major axis of the elliptical track is two times the length of the crank. Conventionally, to improve muscle training efficiency, the length of the crank has to be increased. However, the volume of a cover body in which the crank is enclosed has to be enlarged as well, so that the manufacturing cost and the occupying space of the cover body are increased, and the structural strength of the crank is decreased.

In contrast, in this embodiment, the length of the major axis of the elliptical track (T) is increased to be represented by the first path (S1), so that exercise efficiency can be improved. As for the actual size of the elliptical machine of this disclosure, the length of the first path (S1) is approximately equal to 1.15 times the length of the second path (S2).

With the abovementioned configuration, the elliptical machine of the disclosure has the following advantages:

1. With the arrangement that the wheel seat part 311 is mounted at a front end of the frame unit 3, the length of the entire elliptical machine is decreased and less space is occupied thereby. In addition, the user can step onto the foot pedals 52 from the rear side of the side frame 32 if he/she so chooses.

Figure 1:
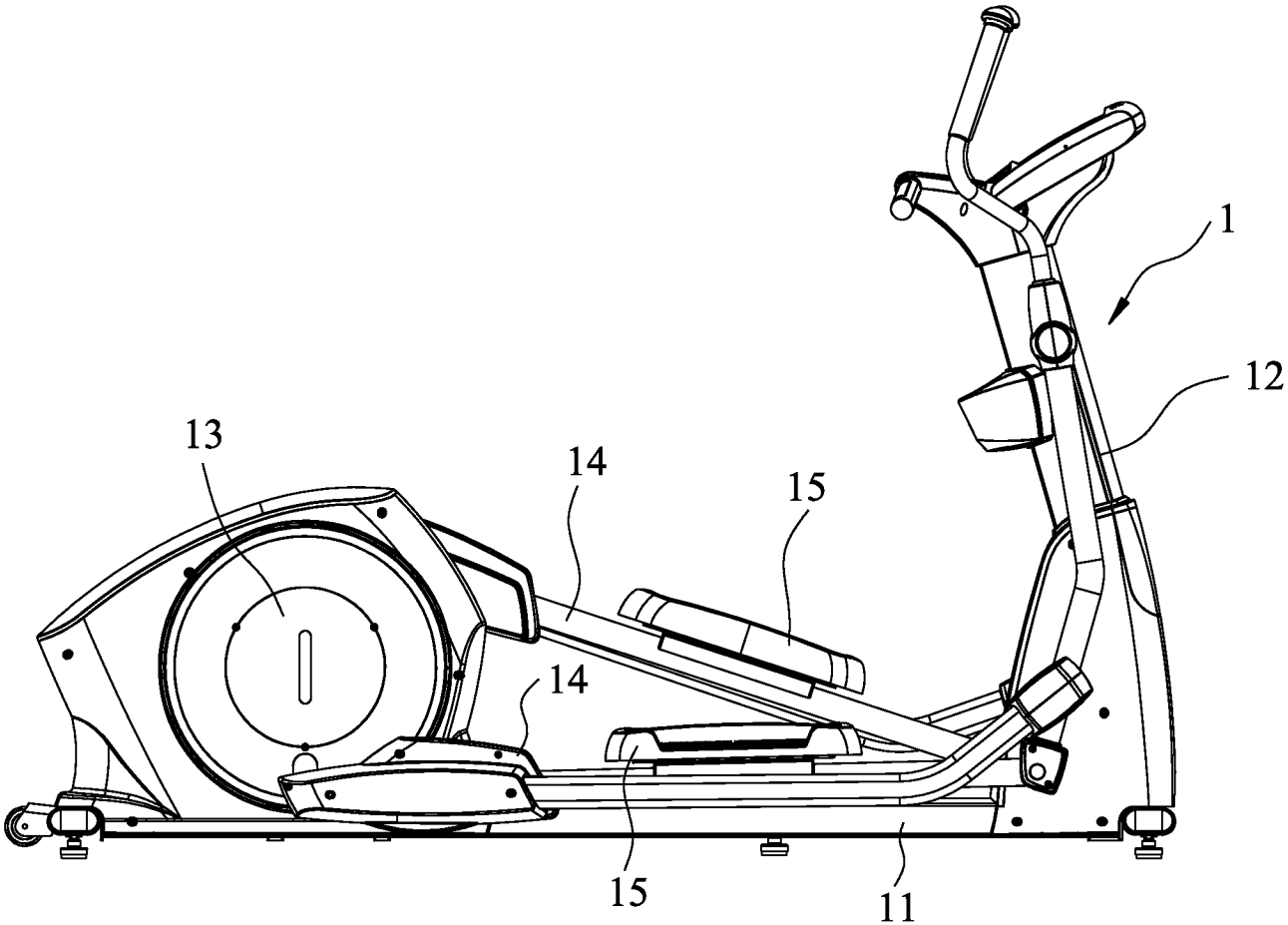
FIG.1 PRIOR ART
FIG. 1 is a side view of a conventional rear-mounted suspension type elliptical machine.
Figure 2:
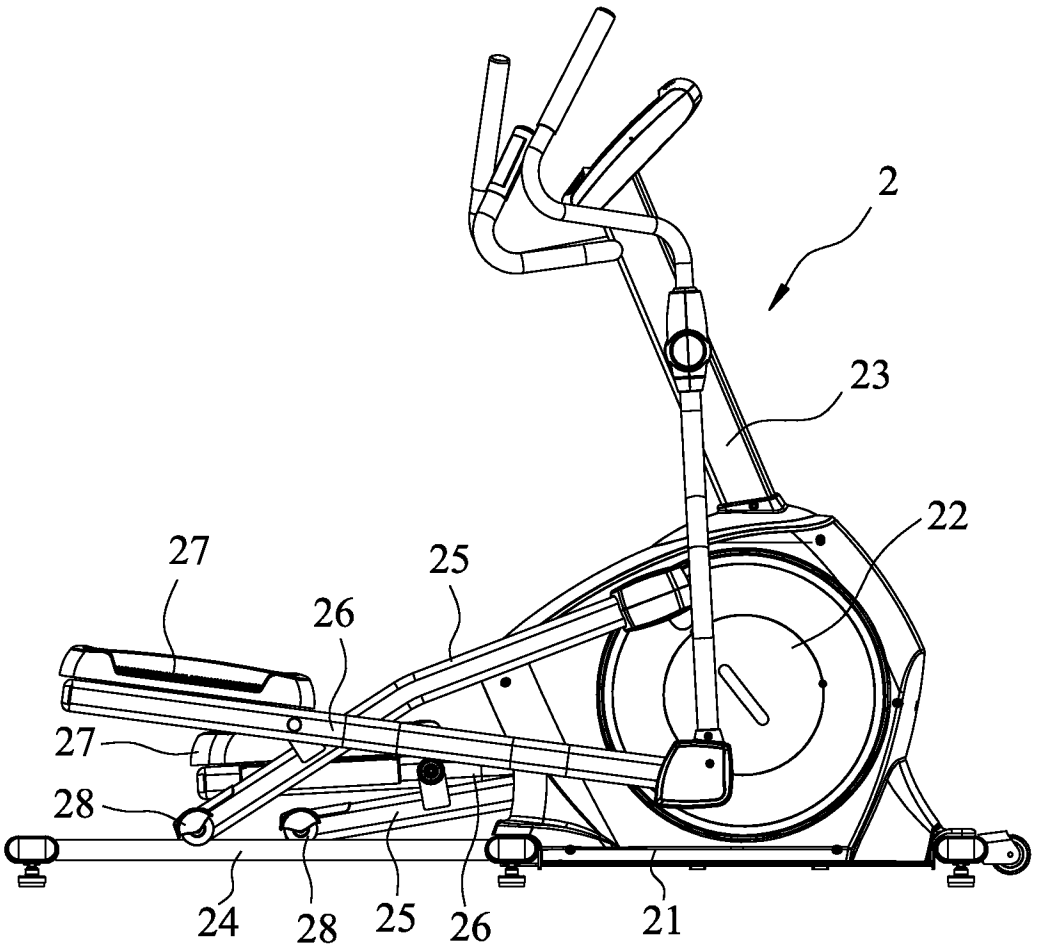
FIG.2 PRIOR ART
FIG. 2 is side view of a conventional front-mounted roller type elliptical machine.

2. With the configuration that the distal ends of the transmission rods 42 are connected pivotally and respectively to the swing rods 44, compared to the aforementioned conventional front-mounted roller type elliptical machine 2 (see FIG. 2), the transmission rods 42 of the disclosure produce less noise during operation and does not need to be maintained frequently, such that the lifetime of the elliptical machine can be prolonged.

3. With the structure among the swing rods 44, the connecting rods 53 and the pedal rods 51 of the exercise units 5, the length of the major axis of the elliptical track (T) is increased to that of the first path (S1), so that exercise efficiency can be improved.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An elliptical machine comprising:

a frame unit that includes a main frame, and a side frame extending rearwardly from said main frame;

a transmission unit that includes a fly wheel unit mounted to said main frame, two transmission rods connected pivotally and respectively to opposite sides of said fly wheel unit, and two swing rods, each of said swing rods being connected pivotally to a distal end of a respective one of said transmission rods that is distal from said fly wheel unit, and being swingably suspended from said side frame; and two exercise units, each of which includes a pedal rod adjacent to and at a lateral outer side of a respective one of said transmission rods, a foot pedal mounted on said pedal rod, and a connecting rod having opposite ends that are connected pivotally and respectively to said pedal rod and a respective one of said swing rods, wherein a distance from an intersection of said connecting rod and the respective one of said swing rods to a top end of the respective one of said swing rods is larger than a distance from an intersection of the respective one of said swing rods and the respective one of said transmission rods to the top end of the respective one of said swing rods.

2. The elliptical machine as claimed in claim 1, further comprising two linking units, each of said linking units including:

a linking seat that is mounted to a bottom end of said foot pedal of a respective one of said exercise units, and that cooperates with said foot pedal of the respective one of said exercise units to surround a respective one of said transmission rods;

two fixing plates that are disposed respectively at opposite lateral sides of said linking seat;

a first shaft that is connected transversely to said fixing plates and that is disposed over the respective one of said transmission rods;

a second shaft that is connected transversely to a bottom portion of said linking seat and that is disposed under the respective one of said transmission rods; and two linking plates that are respectively and pivotally connected to opposite lateral ends of said first shaft and that extend downwardly to said second shaft.

3. The elliptical machine as claimed in claim 2, wherein a longitudinal length of said second shaft is larger than that of said first shaft, said fixing plates and said linking plates extending in an extending direction perpendicular to said first and second shafts, wherein a length of each of said linking plates in the extending direction is larger than a length of said fixing plates.

4. The elliptical machine as claimed in claim 1, wherein said main frame has a wheel seat part mounted with said fly wheel unit, an extension part extending upwardly from said wheel seat part, and a control panel part mounted on said extension part.

5. The elliptical machine as claimed in claim 4, wherein said side frame has two foot frame portions extending respectively and rearwardly from opposite sides of said wheel seat part of said main frame, two first support rod portions extending respectively and upwardly from said foot frame portions, two joint portions mounted respectively to top ends of said first support rod portions, and two second support rod portions respectively extending from said joint portions to said extension part of said main frame, said swing rods of said transmission unit being suspended respectively from said joint portions of said side frame.

6. The elliptical machine as claimed in claim 4, wherein each of said exercise units further includes a handle that extends pivotally from a front end of a respective one of said pedal rods, and that has a middle portion connected pivotally to said extension part of said main frame.

7. The elliptical machine as claimed in claim 1, wherein said transmission unit further includes two interconnecting rods, each of which is connected transversely and pivotally to a respective one of said swing rods, and connected transversely and pivotally to the distal end of the respective one of said transmission rods.

8. The elliptical machine as claimed in claim 1, wherein said fly wheel unit has a rotary shaft, two cranks that are connected respectively from opposite lateral ends of said rotary shaft, that extend respectively in opposite directions, and that are connected respectively and pivotally to said transmission rods, and two rotary wheels mounted respectively to said cranks.

* * * * *